US006923191B2

(12) United States Patent
Cerruti et al.

(10) Patent No.: US 6,923,191 B2
(45) Date of Patent: Aug. 2, 2005

(54) WASHING AGENTS DISPENSER DEVICE FOR A DOMESTIC WASHING MACHINE, NAMELY A DISHWASHER

(75) Inventors: Daniele Cerruti, Fontanetto Po (IT); Stefano Belfiore, Borgo San Martino (IT)

(73) Assignee: Eltek S.p.A., Casale Monferrato (IT)

( * ) Notice: Subject to any disclaimer, the term of this patent is extended or adjusted under 35 U.S.C. 154(b) by 282 days.

(21) Appl. No.: 10/054,676

(22) Filed: Jan. 22, 2002

(65) Prior Publication Data

US 2002/0153029 A1 Oct. 24, 2002

(30) Foreign Application Priority Data

Jan. 26, 2001 (IT) ..... TO2001A0078

(51) Int. Cl.[7] ..... B08B 13/00

(52) U.S. Cl. ..... 134/94.1; 134/93; 68/17 R; 68/207; 222/1; 222/425

(58) Field of Search ..... 68/17 R, 12.18, 68/207, 13 R; 134/94.1, 93; 222/1, 21, 425, 444, 442, 447, 450

(56) References Cited

U.S. PATENT DOCUMENTS 2,361,837 A * 10/1944 Gilmore ..... 222/21
2,806,639 A * 9/1957 Halverson ..... 222/450
2,852,170 A * 9/1958 Reynolds ..... 222/439
3,411,671 A * 11/1968 Harvey et al. ..... 222/652
3,419,187 A * 12/1968 Bazarnic ..... 222/36
3,513,866 A * 5/1970 Alger et al. ..... 68/17 R
3,744,683 A * 7/1973 Leggett ..... 222/446
4,095,722 A * 6/1978 Miller ..... 222/1
4,314,657 A * 2/1982 Perakis et al. ..... 222/162
4,912,681 A * 3/1990 Halsey et al. ..... 366/152.2
5,309,955 A * 5/1994 Torterotot ..... 141/1
5,611,458 A * 3/1997 Ogden et al. ..... 222/1
5,967,366 A * 10/1999 Cason ..... 222/2

* cited by examiner

*Primary Examiner*—Frankie L. Stinson
(74) *Attorney, Agent, or Firm*—Levine & Mandelbaum

(57) ABSTRACT

Dispensing device of washing agents for a household washing machine, in particular a dishwasher, said dispenser having at least a tank for a liquid washing agent and an arrangement for dispensing a dose of said liquid washing agent, wherein this arrangement comprises: a passage, being adapted to put the inside of the tank in hydraulic communication with a discharge outlet for said liquid washing agent; first plugging means, act on said passage and capable of taking a first position due to which the washing agent cannot reach said discharge outlet, and a second position due to which the washing agent is able to reach said discharge outlet; actuating means producing actuation of said first plugging means. According to the invention, controllable safety means act along said passage are provided, which normally operate for preventing washing agent downflow from said tank to said passage, independently from the position or state of the first plugging means.

51 Claims, 8 Drawing Sheets

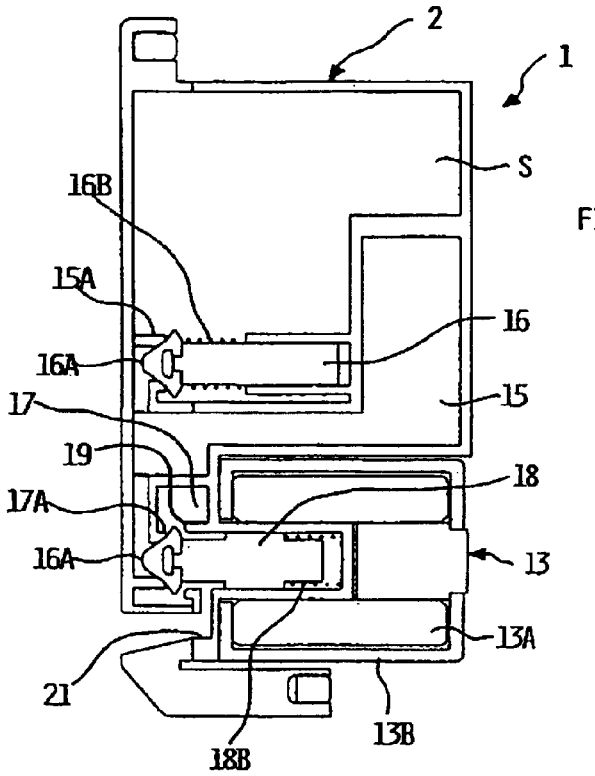
FIG. 9
FIG. 10
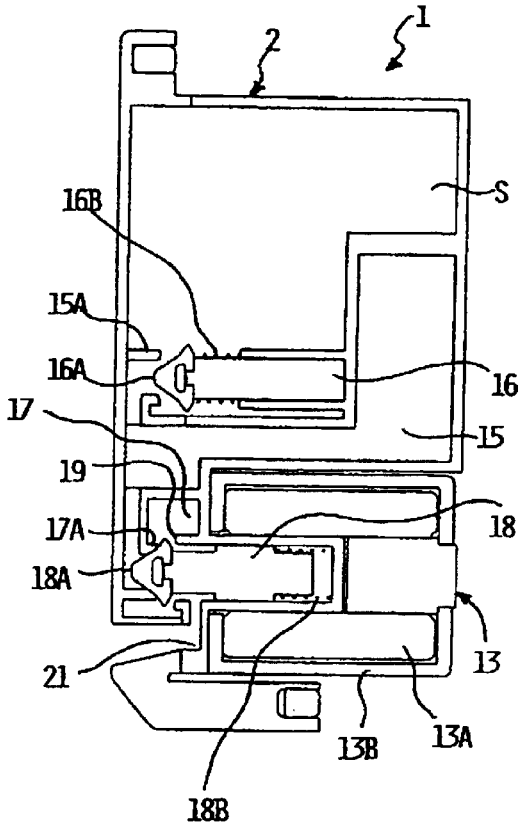
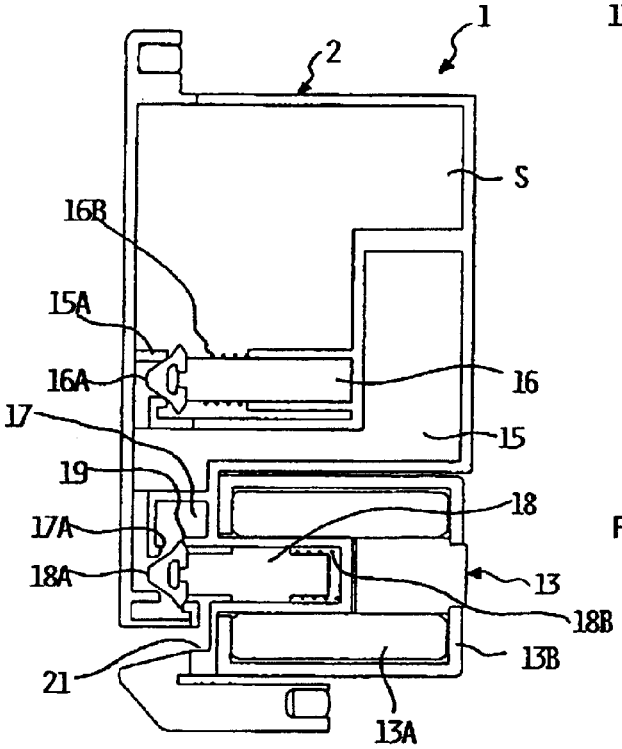
FIG. 11

WASHING AGENTS DISPENSER DEVICE FOR A DOMESTIC WASHING MACHINE, NAMELY A DISHWASHER

BACKGROUND OF THE INVENTION

The present invention refers to a dispensing device of ashing agents for a household washing machine, in particular a dishwasher, as described in the preamble of the annexed claim 1.

As known, washing machines are usually fitted with a dispensing device of washing agents, namely powder and/or liquid detergents and additives; typically, the latter consist of softening substances for laundry washing machines and rinsing aids for dishwashing machines.

In the instance of the dishwashers, the washing agents dispenser usually comprises a body made in plastic material, partially built-in in one of the vertical surfaces delimiting the washing tub of the machine; in most cases, this vertical wall is the dishwasher inner door, i.e. the side of the machine front loading door facing inside the washing tub.

In its front area, the above body delimits a space for containing a washing agent, usually powder or in the form of a tablet, with a tilting or sliding cover; the opening of this cover is appropriately controlled by a machine programmer or timer.

A tank is provided inside the dispenser body for containing a second washing agent of the liquid type, typically a rinsing aid; in general, this tank has a capacity for containing a sufficient amount of liquid agent for several washing cycles: so that the machine user has only to fill the tank periodically, through a proper plug.

A small chamber inside the dispenser is associated with the above tank for dosing the amount of rinsing aid to be dispensed during a washing cycle; to this purpose the dosing system of the rinsing aid uses the opening-closing movement of the machine door, i.e. horizontal in its open position and vertical in its closed position, for dispensing a portion of rinsing aid from the tank to the dosing chamber; during machine operation, the programmer operates an actuator to release a discharge outlet in line with the dosing chamber, so that the amount of rinsing aid can flow from the latter into the washing tub of the dishwasher.

As described above, according to the technique previously known presuppose that the dispenser has to be fastened to the dishwasher door, in order to utilize its opening-closing movement for dosing the rinsing aid required for executing a wash cycle; therefore, for this reason, application of these dispensers is restricted to washing machines with a tilting door around a horizontal axis.

However, in some known washing machines the loading door is not tilting but it is linearly sliding on appropriate guides; with reference to a twin-basket dishwashing machine, reference can be made for instance to the solution described in FR-A-2.674.426; vice-versa, according to other known solutions, the dishwasher has only one basket designed like a sliding drawer for containing the crockery to be washed, whose front wall is actually representing the machine door.

Also in these machines, the washing agents dispenser is fastened to the machine door or anyway to a wall or vertical surface delimiting the washing tub; as a result, the dispenser is always laying on the same resting plane, independently from the door open-closed condition.

Therefore, the dispensers applied to these machines have to be equipped with a proper electric pump, either a vibration or peristaltic pump, in order to perform the dosing and dispensing of the liquid washing agent; however, these pumps are relatively expensive, space requiring and difficult to control; moreover, these pumps may go out of calibration or become defective with time, also considering a possible corrosive capacity of certain liquid washing agents.

On the contrary, other known solutions provide a special hydraulic circuit, being able to convey water inside the device for dispensing the liquid washing agent and convey it into the machine washing tub; however, also these solutions are complicated, expensive and critical, considering that such an hydraulic circuit should be partially housed within the machine door.

SUMMARY OF THE INVENTION

It is the object of the present invention to solve the above drawbacks and provide a dispensing device of washing agents, being able to perform the dosage and dispensing of a liquid washing agent, which is easy to manufacture, has a reliable operation and low cost.

Within this general frame, a first aim of the present invention is to provide a dispensing device of washing agents, being able to perform the dosage and dispensing of a liquid washing agent without employing any vibration or peristaltic pumps, nor special water supply circuits, and without changing the resting plane of the dispenser itself.

A further aim of the present invention is to provide a dispensing device of washing agents, which comprises a minimum number of movable parts, in particular being subject to elementary movements.

A further aim of the present invention is to provide a dispensing device of washing agents, which employs simple reliable actuating and sealing means.

According to the present invention, one or more of these aims are attained by means of a dispensing device of washing agents for a household washing machine, in particular a dishwasher, incorporating the features of the annexed claims, which form an integral part of the description herein.

DESCRIPTION OF THE DRAWINGS

Further aims, features and advantages of the present invention will become apparent from the following detailed description and annexed drawings, which are supplied by way of non limiting example, wherein:

FIGS. 9, 10 and 11 show schematically some sections of the washing agents dispenser according to the present invention, the latter being represented in three operating conditions, respectively;

DESCRIPTION OF THE PREFERRED EMBODIMENT

Figure 1:
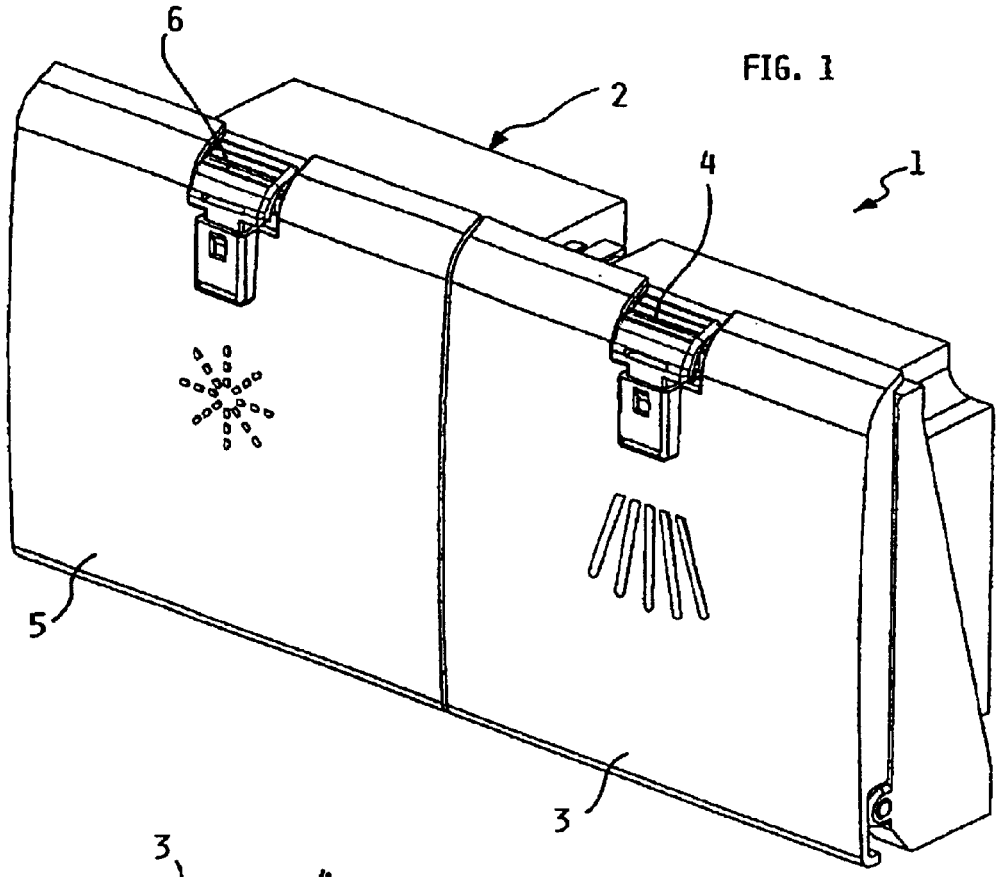
FIG. 1 shows a perspective view of the front side of a washing agents dispenser, according to the present invention.
Figure 2:
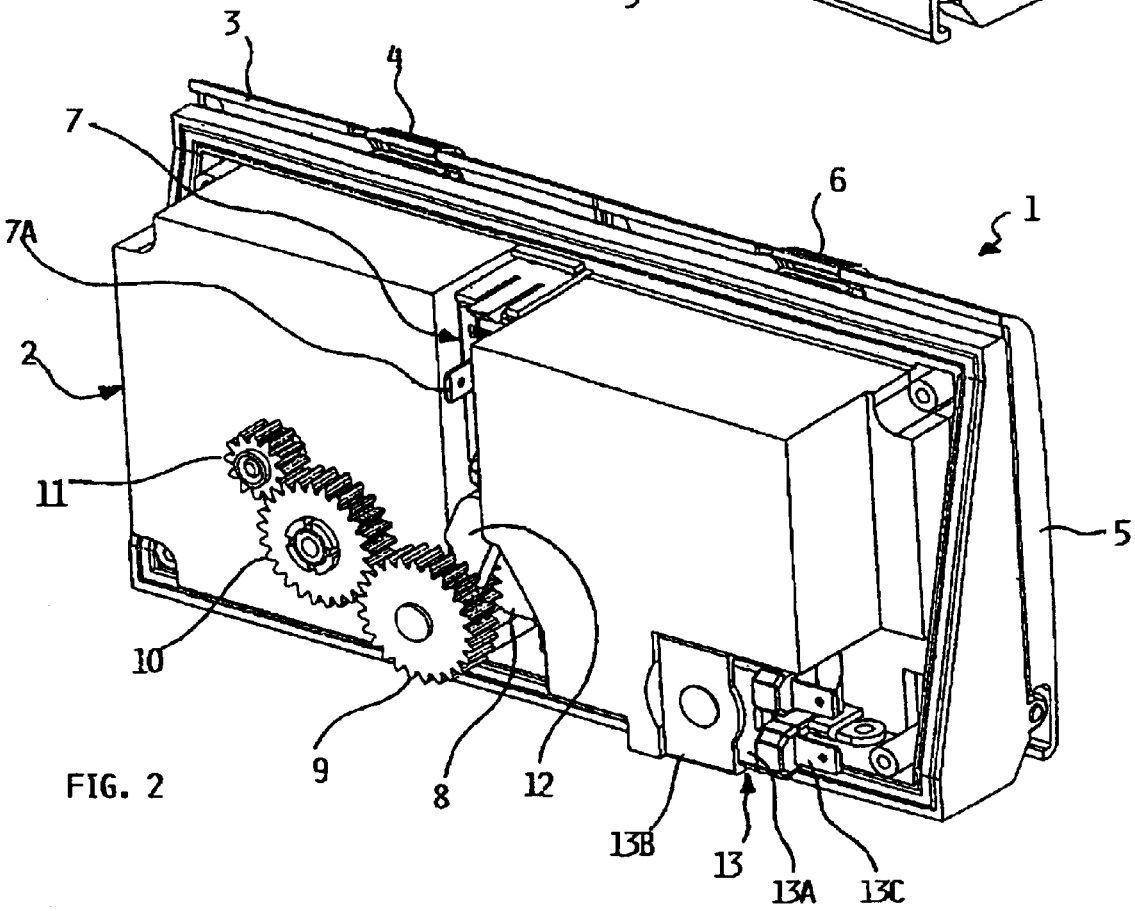
FIG. 2 shows a perspective view of the rear side of the washing agents dispenser, according to the present invention.

In FIGS. 1 and 2, reference 1 indicates a washing agents dispenser in its whole according to the teachings of the present invention, which is provided for application on a washing machine, i.e. a dishwasher in the example described herein.

The dispenser 1 has a main body 2 at least partially housed in an opening provided on a machine wall, in particular in the inner door; in general, the body 2 can be fastened to any vertical surface delimiting a washing tub of the washing machine.

As known in the art, the body 2 of the dispenser 1 is obtained by welding a front piece to a rear piece, both made in thermoplastic material, such as described in EP-A-1 059 058, whose teachings in this connection are incorporated herein by reference.

The body 2 has a recess for containing a determined amount of washing agent either a powder or in tablet form, as well as a tank for containing a certain amount of liquid washing agent, hereafter assumed to be a rinsing aid; the above recess and tank are not directly exhibited in FIGS. 1 and 2.

In FIG. 1, reference 3 indicates a first tilting cover for closing the cited recess containing the washing agent, the lower part of it being commonly hinged to the body 2; reference 4 indicates a common hooking system for the cover 3, of known type, to keep the latter in closed position over the relevant recess containing the washing agent.

Reference 5 indicates a second tilting cover like the previous one, covering the plug of an opening, in communication with the above tank, for filling the latter with the rinsing aid; reference 6 indicates schematically a hooking system for the cover 5, alike the previous one indicated with 4.

A discharge outlet is delimited behind the cover 5, through which a dose of rinsing aid can be flown down into the washing tub of the dishwasher; this discharge outlet and the dispensing procedure for the rinsing aid will be further detailed.

In FIG. 2, reference 7 indicates a first general actuating device in its whole, which is commonly fastened to the body 2 and controls dispensing of the rinsing aid (eventually washing agent) as further described; according to the example, the actuating device 7 may consist of a thermo-actuator having a main structure as described in WO-A-98/32141, whose relevant teachings are incorporated herein by reference.

It will only be mentioned here that thermo-actuators like reference 7 comprise an outer housing, wherein a body made from an electric thermal conducting material (e.g. metal) is placed and it is connected to an electric heater; in this body, a chamber is delimited for containing a thermally expandable material (e.g. wax) and, at least partially, a thrusting element, adapted to displace a piston protruding from the outer housing; typically, the electric heater consists of a PTC resistor with a positive temperature coefficient, electrically supplied by means of two terminals.

When the supply terminals are live, the powered electric heater generates heat causing the expansion of the thermally expandable material: such an expansion produces a linear displacement of the thrusting element outside of the relevant body, causing the piston to move until a preset position usually established by a mechanical end-stop, which can be defined as a final work position. Upon ceasing the power supply, the heater cools down and the thermo-expandable material will shrink, causing the piston and thruster to return to their initial rest position, eventually with the aid of an elastic recall element, such as a spring.

Thermo-actuators as above are mono-stable devices, i.e. besides their normal rest position they only ensure one work stroke and one final work position. Such actuators offer important advantages in view of the considerable working strength or power they are able to develop related to their small size, low cost, low consumption and noiseless operation.

Back to FIG. 2, reference 8 indicates a rack element, which is linearly actuated by the thermo-actuator 7; references 9, 10 and 11 indicate three cooperating gears; reference 12 indicates an arm moving angularly with the gear 9 according to the procedures and scopes further described; the components 7–12 pertain to an actuating mechanism of the dispenser 1, as it will be further detailed.

Always in FIG. 2, reference 13 indicates a second general actuating device fastened to the body 2, pertaining to a rinsing aid dispenser; in the above example, the actuation device 13 consists of a common solenoid fitted with an inductor winding or coil 13A and a relevant magnetic yoke 13B; the ends of the inductor winding 13A are electrically connected to two supply terminals indicated with 13C in FIG. 2.

Figure 3:
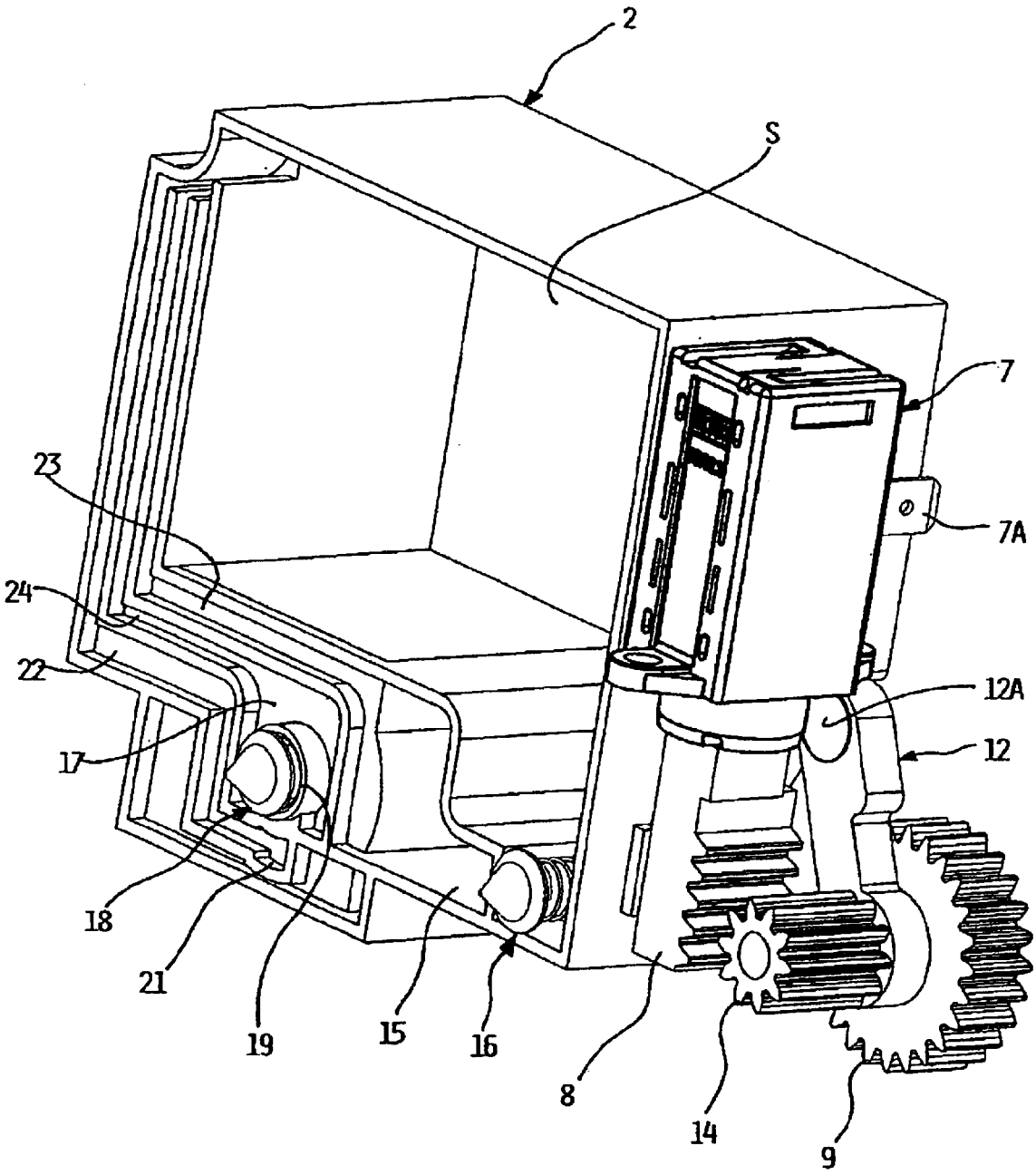
FIG. 3 shows a section plane of a first portion of the washing agents dispenser, according to the present invention.

FIG. 3 shows a portion of the body 2 relating to the area of the dispenser 1, provided for containing, dosing and dispensing the rinsing aid, as well as some elements of the relevant actuating mechanism; it should be noticed how this figure substantially illustrates a front view of the above portion of the body 2, seen from inside the latter.

Reference S indicates a recess forming the rinsing aid tank mentioned above; according to common art, the amount of rinsing aid to be filled in the tank S, through a proper plug, is enough for performing several wash cycles; indicatively, the tank S may have a capacity of 100–150 ml.

Reference 7 indicates the above thermo-actuator, which has an actuation piston not shown in the figures, and some power supply terminals, one of them indicated with 7A.

The actuation piston of the thermo-actuator 7 is associated with the rack element 8 coupled in its use to a fourth gear 14; as it can be noticed in FIG. 3, the gear 14 is associated or keyed to the gear 9, with interposition of the arm 12.

As it can be guessed, the actuation of the actuator 7 causes the piston of the latter to move linearly and produce the displacement of the rack element 8; the movement of the latter causes the angular movement of the gear 14 and its associated components as well, i.e. the arm 12 and gear 9;

the angular movement of the gear 9 will be transferred to the gear 10 and from the latter to the gear 11, for the purposes to be described hereafter.

In FIG. 3 it can also be noticed how the free end of the arm 12 has a seat for housing an attraction element, such as a permanent magnet 12A, whose functions will be further described.

Always in FIG. 3, reference 15 indicates a chamber for dosing the rinsing aid contained in the tank S in order to execute a wash cycle; indicatively, the capacity of the chamber 15 may be 10–15 ml.

Figure 4:
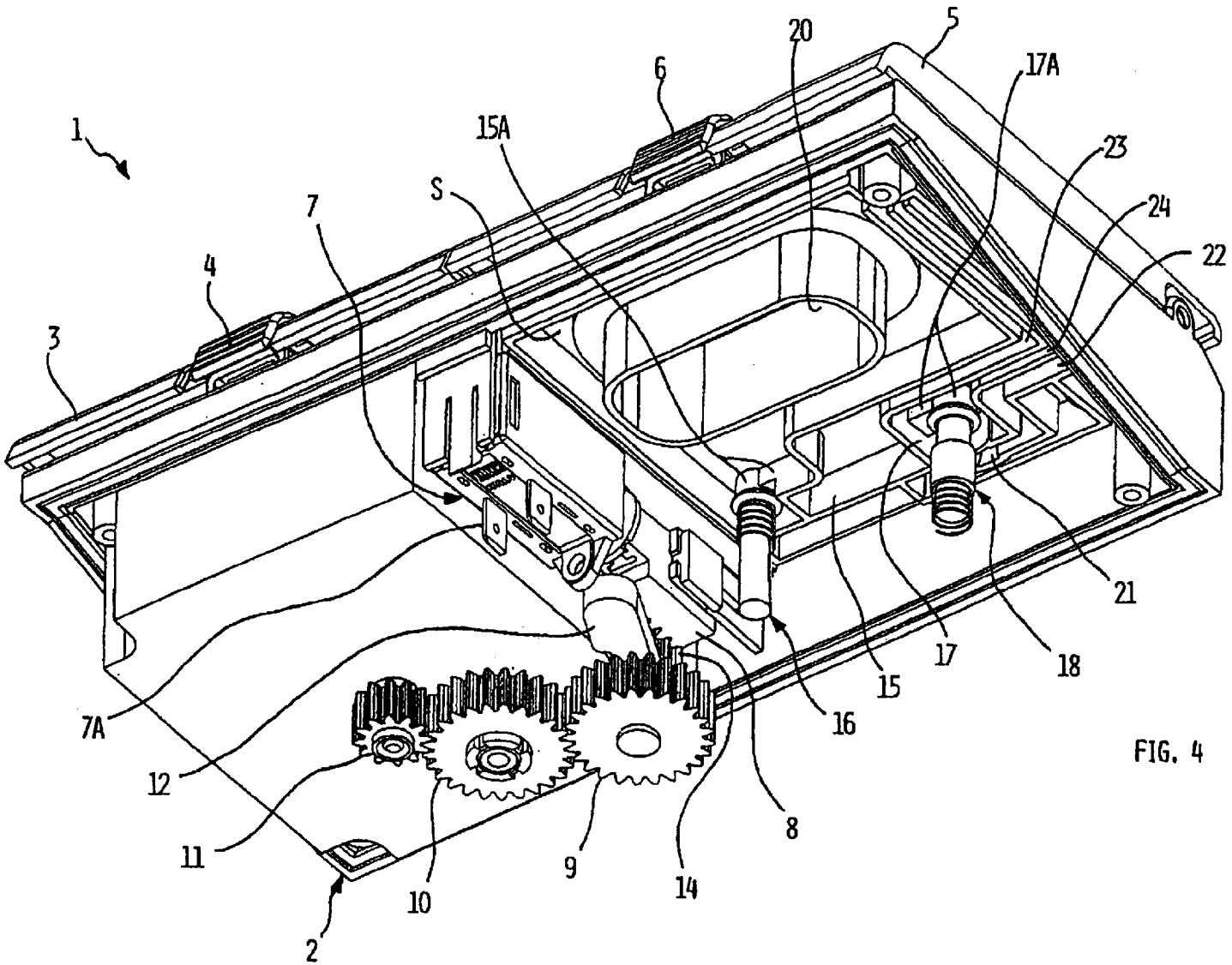
FIG. 4 shows a perspective view of the rear side of the washing agents dispenser according to the present invention, with an omitted wall to exhibit some inner components of the dispenser.

The chamber 15 communicates with the inside of the tank S through an appropriate passage indicated with 14A in FIG. 4; an appropriate plug shown in its whole with reference 16 operates on this passage 15A. Reference 17 indicates a dispensing chamber of the rinsing aid, communicating with the dosing chamber 15 through an appropriate passage indicated with 17A in FIG. 4, which is closed by a suitable plug indicated in its whole with 18; indicatively the chamber 17 may have a capacity of 1–2 ml.

Figure 5:
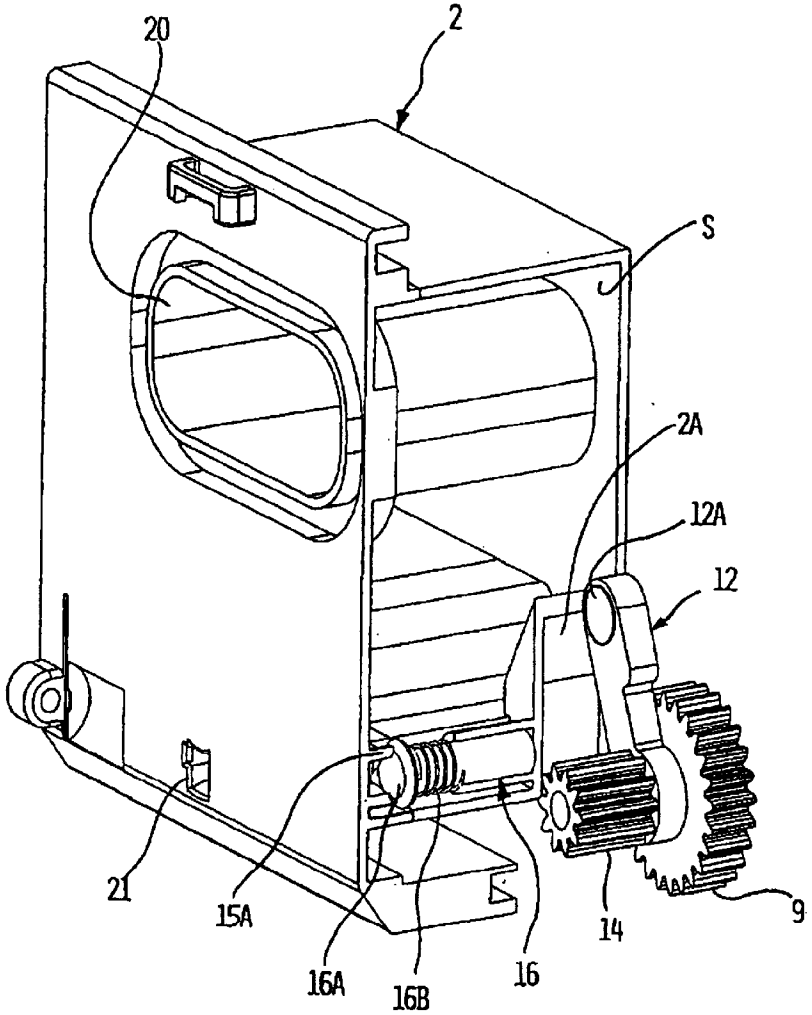
FIG. 5 shows a section plane of a second portion of the washing agents dispenser, according to the present invention.

FIG. 5 illustrates the portion of the body 2 of the dispenser 1 housing the plug 16; the plug 16 has a body made in ferromagnetic material, associated on one end to a common sealing element or stopper 16A having a substantially conical shape; reference 16B indicates a spring, which pushes the plug 16 and consequently the stopper 16A to close the passage 15A, which as said above puts the tank S in communication with the dosing chamber 15 (see FIG. 4).

In FIG. 5 it can also be noticed how in the body 2 a seat or outlet 2A is delimited, for ensuring the angular movement of the arm 12; therefore, as it can be guessed, during the movement of the arm 12, the magnet 12A carried by the latter is capable of reaching the plug 16 backside, with an interlaying wall of the body 2; as a result, in this non limiting example, the magnet 12A is isolated from the tank S and/or from the plug 16 that is immersed in the rinsing aid.

In FIG. 5 also the rinsing aid inlet 20 in the tank S can be seen, which is normally closed by a suitable stopper not illustrated; reference 21 indicates the discharge outlet mentioned above, through which a dose of rinsing aid can be flown down to the washing tub of the dishwasher, as further described.

Figure 6:
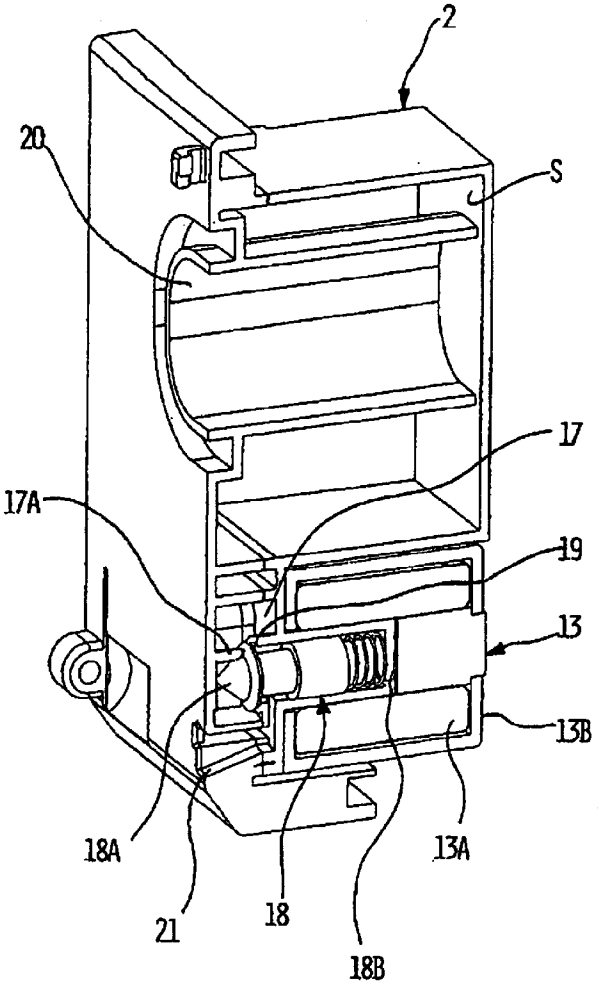
FIG. 6 shows a partial section plane of a third portion of the washing agents dispenser, according to the present invention.

Vice-versa, FIG. 6 illustrates the portion of the body 2 of the dispenser 1 housing the plug 18; also the plug 18 has a body made in ferromagnetic material, associated on one end to a common sealing element or stopper 18A having substantially a conical shape; reference 18B indicates a spring pushing the plug 18 and consequently the stopper 18A to close the passage 17A in communication with the dosing chamber 15 (see FIG. 4).

It should be noticed how in this operating condition the stopper 18A of the plug 18 keeps a passage 19 open for the dispensing chamber 17 to communicate with the discharge outlet 21.

As it can be seen in FIG. 6, the plug 18 actually forms the rotor or movable core of the solenoid 13 of FIG. 2.

When the solenoid 13 is not power supplied electric to the terminals 13C (FIG. 2), the plug 18 is maintained in its rest position by the spring 18B, i.e. with the passage 17A closed by the stopper 18A; should the solenoid 13 on the contrary be supplied, the plug 18 would be moved to win the contrasting force of the spring 18B and let the stopper 18A open the passage 17A and close the passage 19.

From FIG. 6 it can also be noticed how the discharge outlet of the rinsing aid 21 communicates directly with the passage 19.

Back to FIGS. 3 and 4, reference 22 indicates a first vent duct putting the tank S in communication with the discharge outlet 21 and therefore with the environment outside; reference 23 indicates a second vent duct putting the dosing chamber 15 in communication with the environment outside through the vent duct 22; reference 24 indicates a third vent duct putting the dispensing chamber 17 in communication with the environment outside through the vent duct 22.

Operation of the rinsing aid dispenser of the dispensing device 1 according to the present invention is now described also with references to FIGS. 7–8 and 9–11; in this connection it should be noticed how in FIGS. 9–11 showing schematically the operating principle of the above dispenser, some components have been omitted and/or differently arranged with respect to the previous illustrations, for clarity's sake.

It is now assumed to have the tank S filled with a certain amount of liquid washing agent, previously supplied through the inlet 20 of FIGS. 5 and 6; it is further assumed to have a user of the dishwasher starting a wash cycle.

Figure 7:
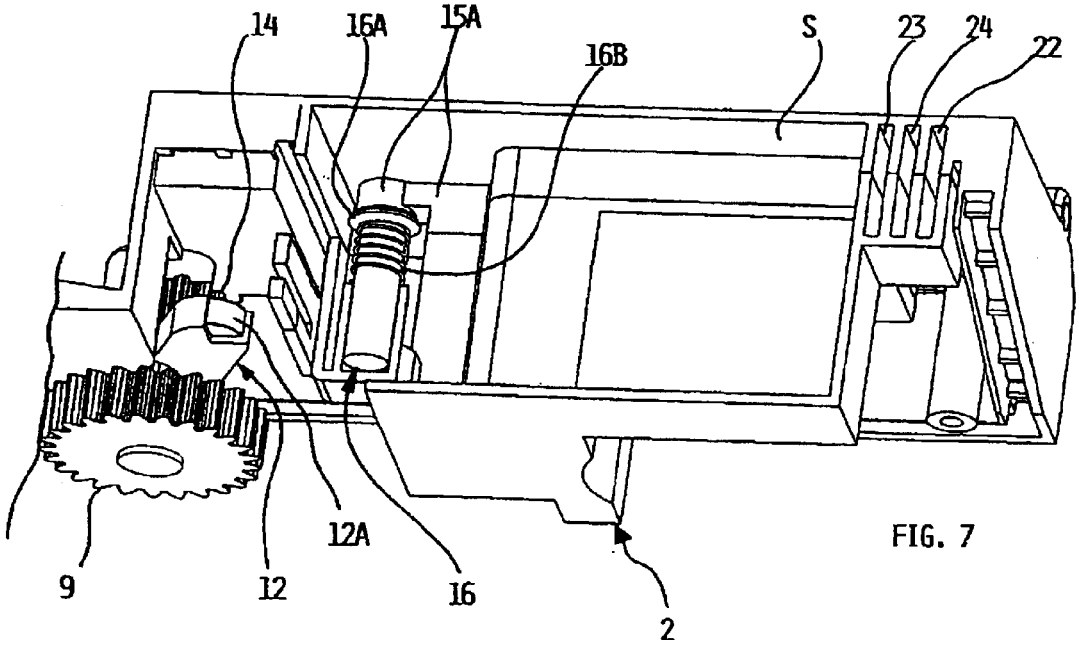
FIGS. 7 and 8 show a partial section of a fourth portion of the washing agents dispenser according to the present invention, the latter being represented in two operating conditions, respectively.

In its rest condition, the actuating mechanism is in the condition illustrated in the FIGS. 2–5; as of interest here and also illustrated in FIG. 7, the arm 12 is substantially directed upwards with the magnet 12A away from the plug 16.

The plug 16 is in its closure position of the passage 15A, so that the rinsing aid contained in the tank S cannot flow into the dosing chamber 15; moreover, since the solenoid is not supplied, the plug 18 is in its closure position of the passage 17A of communication between the chamber 15 and chamber 17, whereas it is in its open condition for the communication passage 19 between the chamber 17 and discharge outlet 21; however, it should be noticed that in such a condition no rinsing aid is available in the chamber 17.

This operating condition of the plugs 16 and 18 is illustrated in FIG. 9.

At an appropriate cycle time, the control system of the machine will supply the thermo-actuator 7; in a preferred embodiment of the invention, this supply is provided to let the thermo-actuator dispensing through a suitable mechanism the solid washing agent contained in the relevant recess behind the small cover 3 of FIG. 1 (e.g. according to procedures to be further described with reference to a possible embodiment of the invention illustrated in the FIGS. 12–14); it is important here to mention how this actuation, provided for dispensing the washing agent in solid form, can also be utilized for dosing the dose of rinsing aid from the tank S to the chamber 15.

Following this supply, in fact, the piston of the thermo-actuator 7 will displace the rack element 8 linearly, causing the angular movement of the gear 14, and as of interest here related to the operation of the rinsing aid dispenser, of the arm 12.

Figure 8:
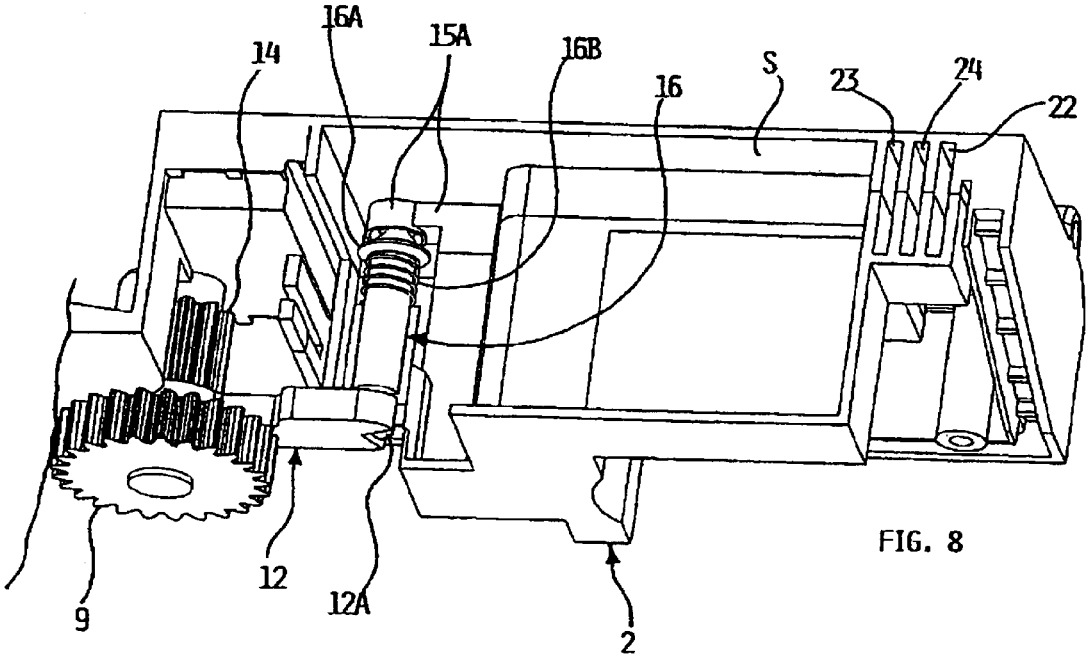

By virtue of the discharge outlet 2A (FIG. 5), the arm will move angularly and let the magnet 12A go over to the rear side of the plug 16, as illustrated in FIG. 8; therefore, during this movement, the attraction force exerted by the magnet 12A causes the plug 16 to go backward and a consequent opening of the passage 15A; thus, a portion of the rinsing aid in the tank S can fill the dosing chamber 15; however, due to the passage 17A being closed by the plug 18, the rinsing aid filling the dosing chamber 15A cannot enter the dispensing chamber 17.

This operating condition is illustrated in FIG. 10.

It should be noticed how the magnet 12A is appropriately sized for its attraction force can reach the plug 16, in spite of the latter being housed inside the body 2, and therefore with a wall of the body is interlaying between the magnet 12A and the plug 16; moreover, this attraction force is high enough to win the contrasting force to the backward motion of the plug 16 as determined by the spring 16B.

It should also be noticed how the mechanism is so conceived to have the arm 12 continuing its angular movement during actuation, so as to overcome the point shown in FIG. 8 (in other terms, the condition illustrated in FIG. 8 is not the stroke stop of the arm 12); for this reason, from a certain point onward of the movement of the arm 12, the attraction force of the magnet 12A will no longer maintain the plug in its open position for the passage 15A; as a result, this passage will be closed by the plug 16 by the action of the spring 16B; upon reaching this operating condition, which is alike the condition of FIG. 9, the dosing chamber 15A is already filled with the required dose of rinsing aid.

It is also highlighted how filling of the chamber 15 during actuation of the thermo-actuator 7 is particularly favored or ensured by the slow motion of the actuator piston; a fast pass of the arm 12 with its relevant magnet 12A near the plug 16 may actually prevent a filling of the chamber 15.

It should be noticed that when supply of the thermo-actuator 7 is subsequently stopped, with the consequent backward movement of its piston, the actuating mechanism will go back to its original position of FIG. 8; thus, the electromagnet will be led to pass again near the plug 16 and cause a new opening of the passage 15A; therefore, in the case wherein the dosing chamber 17A not have been filled with rinsing aid during the forward stroke of the arm 12 and magnet 12A, such a filling would be surely obtained during the backward stroke of the arm and magnet themselves.

At a subsequent cycle time (such as during a rinsing step), the control system of the machine will power the solenoid 13.

As previously mentioned, this causes the piston 18 to move back contrasting the action of the spring 18B, with a subsequent opening of the passage 17A and simultaneous closure of the passage 19.

Thus, a portion of the rinsing aid contained in the dosing chamber 15 can go over to the dispensing chamber 17; however, assuming that the above backward movement of the plug 18 causes the closure of the passage 19, this rinsing aid cannot reach the discharge outlet 21. This operating condition is illustrated in FIG. 11.

A few seconds later, considered a sufficient time for filling the chamber 17 with rinsing aid, power to the solenoid 13 is stopped and the system goes back to a condition like in FIG. 9; thus, the action of the spring 18B causes the plug 18 to return to its original closed position of the passage 17A and opening position for the passage 19.

Thus, the rinsing aid loaded in the dispensing chamber 17 can reach the discharge outlet 21 and then reach the washing tub of the machine; the further loading of the rinsing aid from the chamber 15 to the chamber 17 is prevented, because the plug 18 is now closing again the passage 17A.

Based on the manufacturing structures being chosen, the control system of the machine can be programmed for several subsequent power supplies to the solenoid 13, in order to perform a plurality of separate dosages of the rinsing aid for a total quantity equaling the quantity contained in the dosing tank 15; on the other hand, in alternative, the capacity of the dispensing chamber 17 may equal at least the capacity of the dosing chamber 15, and the power time of the solenoid 13 could be calculated to permit the total downflow of the contents of the chamber 15 to the chamber 17; thus, the whole dose of rinsing aid dosed by the chamber 15 provided for performing a wash cycle may be dispensed in just one solution.

From the above description it is clear that the dispensing system of the liquid washing agent has substantially two valves, represented by the plugs 16 and 18, the first one having a safety function against the emptying of the main tank S, in particular in case of a defective plug 18, whereas the second has a real and true dispensing function.

As seen, the above safety valve 16, normally closed type, has substantially a core with sealing means represented by the stopper 16A, and of spring 16B; this valve 16 is immersed in the rinsing aid and is controlled from outside by means of a magnet 12A associated with the cinematic chain 9–12, 14 operated by the actuator 7.

Also the dispensing valve 18 has substantially a core with sealing means represented by the stopper 18A, and of spring 18B, which is actuated from outside by means of an electromagnet or solenoid 13. This valve 18 is a normally closed type with respect to the passage 17A and of normally open type with respect to the passage 19; therefore, it is practically a double valve associated with a single actuation element or movable core 18.

The above valves 16 and 18 are located along a system of chambers to delimit a main tank S containing most quantity of the rinsing aid, connected with an interlaying safety valve 16 to a dosing chamber 16, the latter being also connected to a dispensing chamber 17 with an interlaying dispensing valve 18.

From the above it can be guessed how the control system of the dispenser previously described is extremely simple, since it presumes a simple supply for a limited time of two actuators at different times; also manufacture of the above dispenser is extremely simple and cost effective.

The part of the body 2 delimiting the tank S, the chambers 15 and 17, the venting ducts 22, 23 and 24 can be actually obtained by the molding of a thermoplastic material with quite elementary operations; on the other hand, the plugs 16 and 18, their relevant springs and stoppers, the thermo-actuator 7 and solenoid 13 are standard components normally manufactured in large series, i.e. high reliability and low-cost components (in particular, the solenoid 13 may be manufactured with the same components normally employed for manufacturing solenoid valves for household appliances); the same applies for the components 812 and 14 of the cinematic actuation chain.

The invention has been described with specific reference to the dosing and dispensing of rinsing aid for a dishwashing machine; however, it is clear that its application for any type of liquid washing agents and to any other washing machine, such as a laundry washer, is also possible. Moreover, the dispenser according to the invention can be fastened to any vertical wall of a washing machine.

The features of the present invention are clear from the above description, as well as from the annexed claims forming an integral part of it.

From the above description and annexed drawings also the advantages of the present invention are clear. In particular:

- both the dosing and dispensing of the liquid washing agent is obtained without any changes to the laying or fastening plane for the dispenser itself, nor do they require any vibration pump or peristaltic pump, or still special water intake circuits;
- the dispenser can be assembled on sliding doors or surfaces or walls constantly vertical;

the system is intrinsically safe with respect to any leakage risk of the liquid washing agent outside the device, due to the presence of at least two separate valves;

the movements required for dosing and dispensing the liquid washing agent are of elementary type; moreover, the movement required for performing the dosing stage of the rinsing aid (namely the safety function exerted by the valve 16) can be obtained through an actuation normally provided for other purposes (i.e. dispensing of the washing agent in solid form);

the actuating means necessary for operating the device are simple to operate and ensure a reliable control with time;

the components of the dosing and dispensing system of the liquid washing agent have a simple low-cost manufacture and assembly;

the safety function can be obtained through a slow moving actuator.

It is clear that many changes are possible for the man skilled in the art to the dispensing device of washing agents for a household washing machine, in particular a dishwasher described above by way of example, without departing from the novelty spirit of the innovative idea.

It has been previously mentioned that the dispenser of liquid washing agents according to the invention can be combined with a dispenser of powder detergents or in tablet form; however, it is clear that the dispenser device according to the invention may only comprise the above dispenser of liquid washing agents.

The two actuators 7 and 13 may differ from the type previously described by way of example; it is also clear that the valve 16 may be controlled in the same way as the valve 18, i.e. by means of a specific actuator, such as an electromagnet; moreover, the thermo-actuator 7 may be replaced by a motor fitted with a suitable gear reducer or an electromagnet equipped with a known delay element, e.g. hydraulic type.

Obviously, the presence of the thermo-actuator 7 or any other actuator can also be advantageously utilized for operating an automatic opening system of the cover 3 of FIG. 1, which closes the recess containing the washing agent in solid form (either powder or tablet); in this case, the piston stroke of the thermo-actuator 7 will be duly utilized for actuating a known concept of kinematics, able to actuate the hooking system 4 of FIG. 1, to cause automatic opening (obtained e.g. by the spring) of the cover 3.

On the other hand, according to a particular advantageous implementation, the actuation system previously described is particularly advantageous in order to obtain a rotating dispenser of either the powder or solid washing agent.

Figure 13:
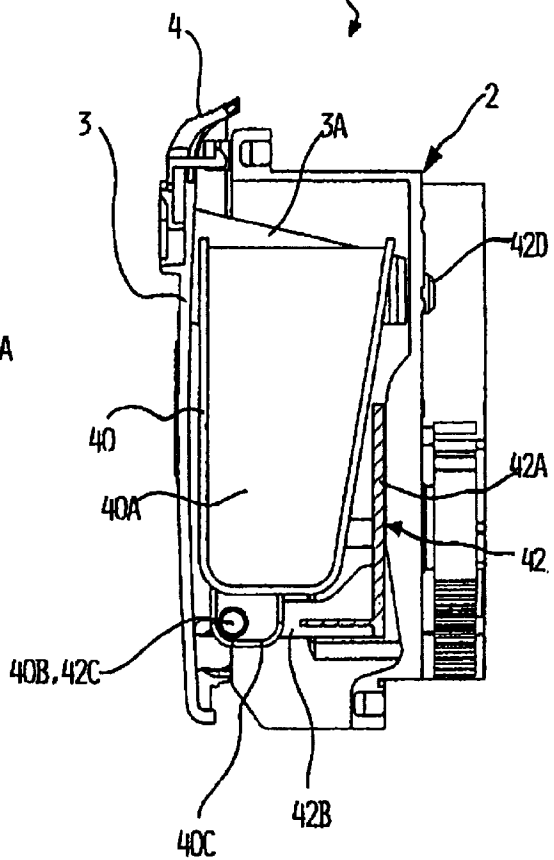
FIG. 13 shows a section of the dispenser of washing agents according to the embodiment of FIG. 12.
Figure 12:
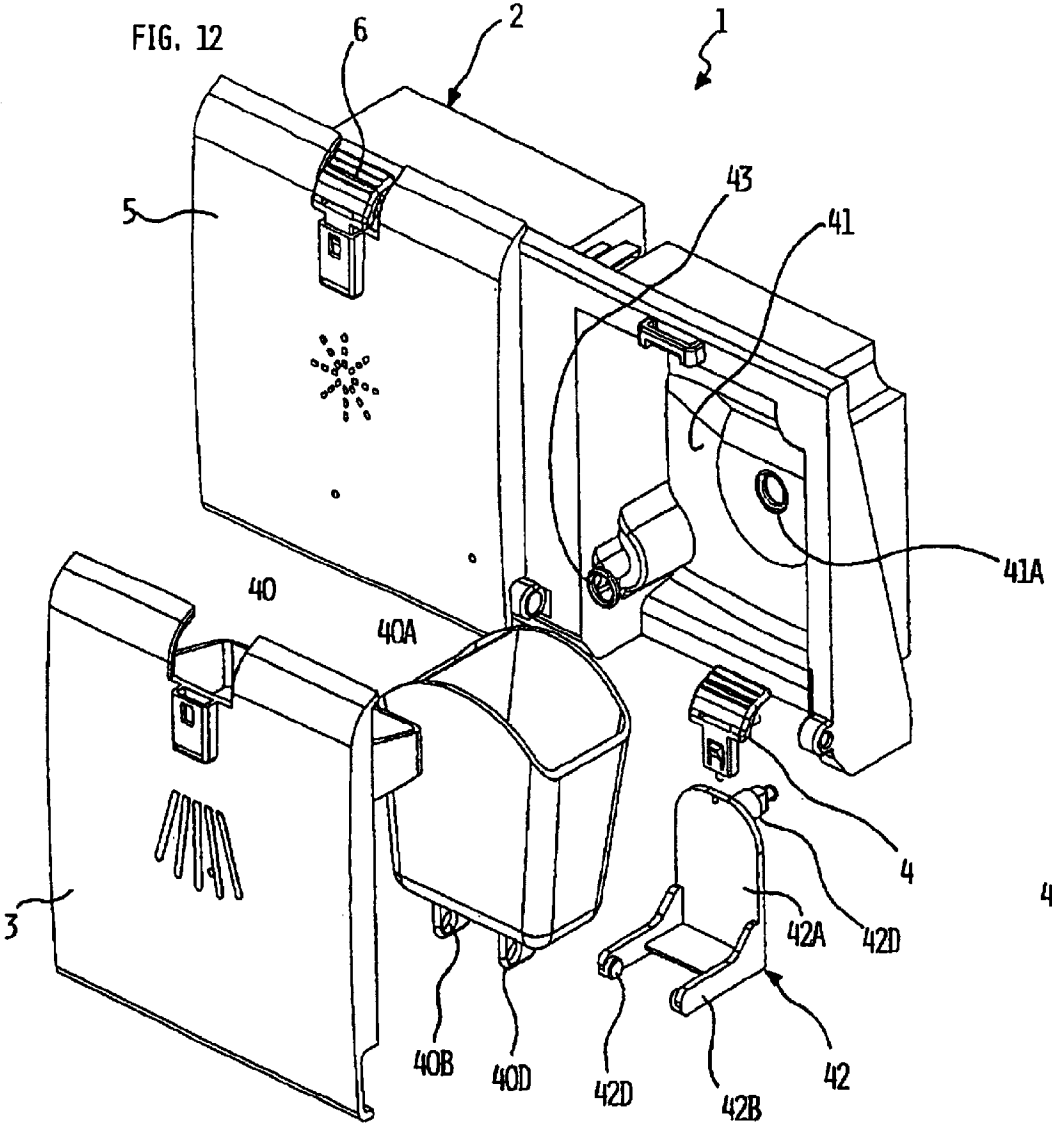
FIG. 12 shows a partial exploded view of the dispenser of washing agents according to the present invention, according to a possible embodiment.
Figure 14:
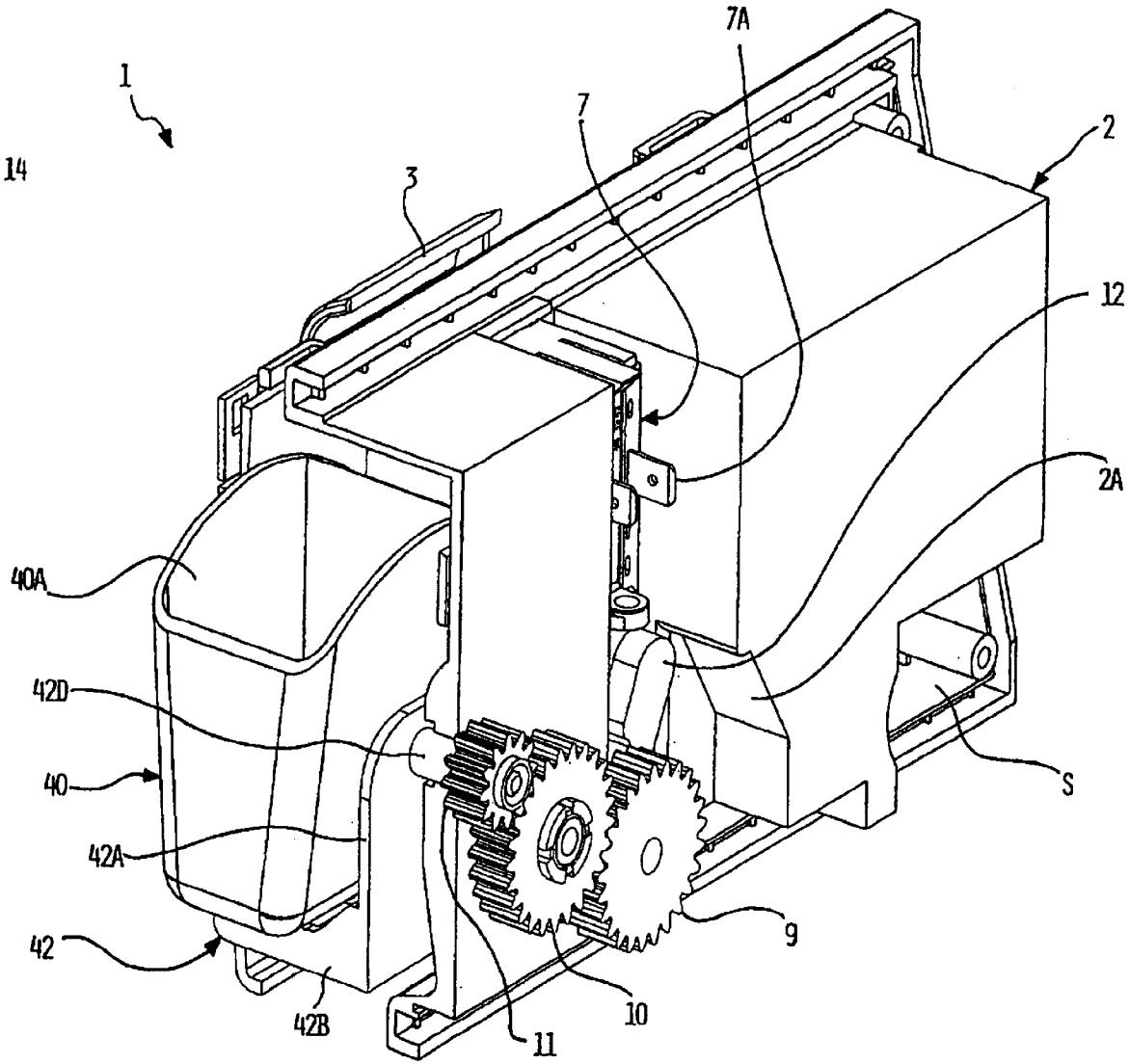
FIG. 14 shows a perspective view of the rear side of the washing agents dispenser according to the embodiment of FIG. 12, with an omitted portion to exhibit some inner components.

This embodiment of the invention is illustrated in FIGS. 12, 13 and 14.

In these figures, reference 40 indicates a tilting container in its whole, provided for receiving a fixed dose of washing agent for executing a wash cycle, which is assumed here to be in powder; the container 40 can be easily made in one piece molding it from thermoplastic material.

Reference 41 indicates a seat delimited in the body 2 of the dispenser, which is provided for housing the container 40; in general, the seat 41 is larger than the container 40, so as to let the latter rotate inside the seat 41; in the specific example above, the lower portion of the seat 41 is open downwards to provide for a discharge outlet of the washing agent, as further explained.

From the FIGS. 12–14 it can be noticed how the container 40 has at least an inner recess 40A, open upwards, able to contain the required amount of washing agent for the execution of a wash cycle; reference 42 indicates a supporting and actuating fork element of the container 40, located in the seat 41.

The fork element 42 is in the form of a central plate 42A, from which two parallel flanges 42B depart frontally, each one having a pin 42C; the pins 42C will be coupled in the holes 40B delimited on the relieves 40C departing from the lower surface of the container 40.

A shaft 42D departs from the rear side of the central plate 42A goes through an opening 41A delimited on the bottom of the seat 41, which has a seat for a suitable seal ring 43 (FIG. 12); as it can be noticed in FIG. 14, the gear 11 of FIG. 2 is keyed on the end of the shaft 42D protruding out on the rear side of the body 2.

Also the fork element 42 can be advantageously manufactured in one piece from thermoplastic material.

As it can be guessed, by virtue of the coupling type between the holes 40C and the pins 42C, the container 40 is assembled inclinable with respect to the fork element 42; therefore, the container 40 can be partially tilted forward outside of the seat 41, to permit filling the recess 40B with the washing agent.

To this purpose, a flange 3A is delimited on the rear side of the cover 3, wherein the upper portion of the container 40 is inserted; therefore, if the cover 3 is either drawn or opened, the flange 3A will pull the container 40 forward and cause it to tilt forward; vice-versa, if the cover 3 is closed, its rear surface will cause a thrust on the container 40, i.e. taking it back inside the seat 41; the cover 3 and the container 40 may be differently coupled from the example above or joined together.

As it can be guessed, being the fork element 42 joined to the gear 10, rotation of the latter produced by the thermo-actuator 7, as previously described, is capable of causing rotation of the container 40 by about 180°; thus, the opening of the recess 40B can be brought in line with the lower section of the seat 41, which, as said, is directly open towards the inside of the washing tub, for discharging the dose of washing agent.

Operation of the device according to the suggested embodiment is very simple.

To that purpose, the device is assumed to be in the condition of FIG. 13 or 14.

After having loaded the crockery to be washed in the washing tub, the user opens the cover 3 operating the hooking system 4, which in this case will be a manually operated system; by so doing, the flange 3A will draw the container 40 and cause it to tilt forward outside its relevant seat 41.

In this operating condition, the user can fill in the recess 40B of the container 40 the dose of washing agent required for executing the wash cycle. Then the user will close again the cover 3, doing so, he will actually also push the container 40 inside the seat 41, as previously described; the machine door can now be closed and the wash cycle started as normally known.

At the appropriate time of the wash cycle, the control system of the machine will electrically supply the thermo-actuator 7, as for the previous description.

The piston of the thermo-actuator 7 causes the rack element 8 to move with the relevant angular movement of the gear 14 and consequently of the gears 9, 10 and 11. Rotation of the gear 11 causes an analogous rotation of the fork element 42 by means of the shaft 42D, and a consequent overturning of the container 40 with respect to the position illustrated in FIG. 13.

It should be noticed, in this connection, how the piston stroke of the thermo-actuator 7 and the ratios between the teething of the rack element 8 and the gears 9–11 will be advantageously provided for obtaining the movement by about 180° of the container 40 following a power supply cycle of the thermo-actuator 7 (which may also be replaced by an actuator of different type, suitable for producing a linear movement of a few millimeters). It should also be noticed that the dimensions of the flange 3A and of the upper portion of the container 40 are chosen to prevent that the first one from hindering the angular movement of the second.

With the above overturning of the container 40, the washing agent is obviously expelled from the recess 40B to the lower open section of the seat 41, and consequently discharged into the washing tub.

Obviously, actuation of the thermo-actuator 7 will also cause the movement of the arm 12 with a consequent pre-dosing or filling of the rinsing aid required in the chamber 15, as previously described.

The supply condition of the thermo-actuator 7 can be maintained for the whole duration of the wash cycle to prevent the recess 40B from being filled with the water sprayed inside the washing tub of the machine.

Anyway, when the control system of the machine stops power supply, the piston of the thermo-actuator, the rack element 8 and the gears 9–11 (and the arm 12) go back to their respective starting positions; thus, also the fork element 42 returns to its initial position, causing the container 40 to receive a rotary movement opposed to the previous one, so as to take it back to the operating condition of FIG. 13 or 14.

As previously explained, the return of the mechanism 7–12, 14 to its starting position causes a new actuation of the valve 16; this ensures a new filling of the dosing chamber 15, should it have been completely emptied while the wash cycle is going to end.

Also the embodiment providing the washing agent dispenser as a rotary container 40 has an extremely simple and low-cost manufacture.

The part of the body 2 delimiting the seat 41 can be actually obtained molding it with elementary operations from thermoplastic material; the same applies for the container 40 and for the fork element 42; as it can be guessed, also the assembly operations of the various components of the washing agent dispenser are very simple.

It should be noticed how the suggested embodiment ensures manufacture of a dispenser device favoring the user's actions to all effects for filling either a solid or powder washing agent; for this reason, the dispenser 1 according to the suggested embodiment can also be advantageously assembled on fixed vertical surfaces, linear sliding doors and drawer-like baskets.

The invention has been described referring to the use of actuating means being able to generate a thrust on the rack element 8; however, it is clear for the man skilled in the art how a few simple modifications to the thermo-actuator 7 would permit to replace it with a thermo-actuator capable of exerting a traction instead of a thrust, or be a rotary or angular movable type.

Moreover, according to the embodiment described above, the dispensing device 1 according to the invention has two separate actuating means 7 and 13, one provided for dosing the liquid washing agent (and likely dispensing of a solid washing agent), and the other for dispensing it; however, it is clear for the man skilled in the art that the dispenser described above may be of the type fitted with a mechanism (which could be associated with the magnet 12A) able to produce actuation of the plugs 16 and 18 at different times, through a single actuating means, such as a thermo-actuator, e.g. according to the technique described in EP-A-0 602 572, or FR-A-2.593.379, or DE-A-33 04 037, whose teachings in this direction are incorporated herein.

Finally, it is underlined how the arm 12 and more in general the magnet 12A may be associated with components of the actuation mechanism differing from the gear 14.

It is obvious that many other changes are possible for the man skilled in the art to the dispenser of washing agents for a household washing machine, in particular a dishwasher as previously described, and it is also clear that in practical actuation of the invention the various forms, proportions and materials described above may differ from the ones described above by way of example and be replaced by technical equivalent elements.

What is claimed is:

1. A dispensing device of washing agents for a household washing machine, said dispensing device comprising a tank for containing a liquid washing agent and an arrangement for dispensing a dose of said liquid washing agent, said arrangement comprising:

a passage adapted to put the inside of said tank in communication with a discharge outlet for said liquid washing agent;

a dosing chamber for said liquid washing agent in hydraulic communication with said tank and said passage, said dosing chamber being adapted for at least partially dispensing said liquid washing agent contained therein in a washing cycle of said household washing machine;

first plugging means acting on said passage and capable of taking a first position, in which the washing agent cannot reach said discharge outlet, and a second position, in which the washing agent is able to reach said discharge outlet;

first actuating means producing actuation of said first plugging means, and further comprising second plugging means operative along said passage to prevent washing agent downflow from said tank to said dosing chamber, second actuating means operatively connected to said second plugging means and adapted to produce actuation of said second plugging means independently of the position of said first plugging means, the first plugging means being provided for dispensing at least part of the liquid agent contained in said dosing chamber in a washing cycle of said household washing machine.

2. A device according to claim 1, wherein said second plugging means are adapted to prevent downflow of liquid washing agent from said tank to said dosing chamber when said first plugging means permit downflow of the washing agent to said discharge outlet, said downflow only being permitted when said first plugging means reach said second position or due to a malfunction of said first plugging means.

3. A device according to claim 1, wherein said second plugging means are provided along said passage upstream of said first plugging means.

4. A device according to claim 1, wherein said second plugging means are disposed between said tank and said dosing chamber.

5. A device according to claim 1, wherein said passage comprises a dispensing chamber of said liquid washing agent, in hydraulic communication with said dosing chamber, said first plugging means operating between said dosing chamber and said dispensing chamber, said dispensing chamber being in hydraulic communication with said discharge outlet.

6. A device according to claim 5, wherein:

in said first position, said first plugging means prevent downflow of liquid washing agent from said dosing chamber to said dispensing chamber and permit downflow of liquid washing agent eventually contained in said dispensing chamber to said discharge outlet;

in said second position, said first plugging means enable downflow of liquid washing agent from said dosing chamber to said dispensing chamber and prevent downflow of liquid washing agent eventually contained in said dispensing chamber to said discharge outlet.

7. A device according to claim 1, wherein said second plugging means are capable of first and second operating conditions, where:

in the first operating condition, reached when said first plugging means are in said second position, said safety means prevent downflow of liquid washing agent from said tank to said dosing chamber;

in the second operating condition, reached when said first plugging means are in said first position, said safety means permit downflow of liquid washing agent from said dosing chamber to said dispensing chamber.

8. A device according to claim 1, further comprising venting means for communication with the environment outside said tank and/or said dosing chamber and/or said dispensing chamber.

9. A device according to claim 1, wherein said second plugging means are capable of being completely immersed in the liquid washing agent, contained in said dosing chamber with said second actuating means being outside said tank and outside said dosing chamber.

10. A device according to claim 1, wherein at least one of said first and second plugging means comprises an element made from ferromagnetic material and a sealing means.

11. A device according to claim 10, comprising a sole actuator including said first and second actuating means, said sole actuator being a sole mechanism adapted to produce actuation of said first and second plugging means at different times.

12. A device according to claim 11, wherein an element made from ferromagnetic material is associated with a component of said sole mechanism.

13. A device according to claim 10, further comprising a magnetic element associated with a component of a mechanism operated by said actuating means.

14. A device according to claim 13, wherein said component is angularly movable.

15. A device according to claim 14, wherein during the movement of said component the attraction force exerted by said magnetic element is capable of producing the switching of said safety means or second plugging means from said first to said second operating condition, or vice-versa.

16. A device according to claim 1, wherein said actuating means comprise a slow operating actuator.

17. A device according to claim 1, wherein at least one of said first and second actuating means comprises a solenoid.

18. A device according to claim 17, wherein said first plugging means comprises an armature of said solenoid.

19. A device according to claim 1, further comprising a second arrangement for dispensing at least one dose of a second washing agent, in solid form or powder.

20. A device according to claim 19, wherein said actuating means actuate said second arrangement, through a mechanism.

21. A device according to claim 20, wherein said mechanism comprises a straight toothed element or rack, capable of moving by the action of said actuating means, and at least a gear engaged to said rack.

22. A device according to claim 19, wherein said second arrangement comprises a recess containing said second washing agent, a cover for closing said recess and means for maintaining said cover in its closed position.

23. A device according to claim 19, wherein said second arrangement comprises a dispenser body delimiting at least a space for containing a dose of said second washing agent, said dispenser body being rotary around a first axis.

24. A device according to claim 23, wherein said dispenser body is capable of angular movement with respect to a second axis, substantially perpendicular with respect to said first axis.

25. A device according to claim 23, further comprising a seat housing said dispenser body, the latter being capable of taking a first position, in which said dispenser body is inserted in said seat, and a second position, in which said dispenser body is inclined to the outside of said seat, in order to permit intake of a dose of said second washing agent in said space.

26. A device according to claim 25, wherein an area of said seat is directly facing or open to the inside of the washing tub of the machine whereon the device is assembled.

27. A device according to claim 26, wherein said dispenser body is capable of rotating around said first axis, in order to bring the aperture of said space substantially in line with said area for permitting discharge of the dose of said second washing agent.

28. A device according to claim 1, wherein said dispenser body is sustained by a supporting element capable of angular movement.

29. A device according to claim 28, wherein said supporting element has at least a fork portion, said dispenser body being assembled movable and/or inclinable with respect to said supporting element.

30. A dispensing device of washing agents for a household washing machine, said dispensing device comprising a tank for containing a liquid washing agent and an arrangement for dispensing a dose of said washing agent, said arrangement comprising:

means forming a dosing space adapted to receive and contain at least a portion of the liquid washing agent contained in said tank, said portion of the liquid agent being at least partially dispensed in a washing cycle of said household washing machine;

a passage adapted to permit downflow of liquid washing agent from said dosing space to a discharge outlet of said liquid washing agent;

first plugging means acting on said passage and capable of taking a first position at which the washing agent cannot reach said discharge outlet, and a second position, which the washing agent is able to reach said discharge outlet;

an actuator capable of actuating said first plugging means, and comprising safety means switching between first and second operating conditions, where:

in the first operating condition, reached when said first plugging means are in said second position, said safety means prevent downflow of liquid washing agent from said tank to said dosing space;

in the second operating condition, reached when said first plugging means are in said first position, said safety means permit downflow of liquid washing agent from said tank to said dosing space in order to define a washing liquid agent dose to be at least partially dispensed in a washing cycle of said household washing machine.

31. A device according to claim 30, wherein said first safety means are adapted to prevent downflow of liquid washing agent from said tank to said dosing space when said first plugging means permit downflow of washing agent to said discharge outlet, said downflow being permitted when said second position is reached by said first plugging means, or due to a malfunction of said first plugging means.

32. A method for dispensing a liquid washing agent in a household washing machine, by means of a dispenser having at least a tank for containing a liquid washing agent comprising:

admission of at least a portion of the liquid washing agent from said tank to a dosing space defining a liquid washing agent dose to be at least partially dispensed in a washing cycle of said household washing machine, admission of a portion of the liquid washing agent from said dosing space to a dispensing space wherefrom dispensing said agent is permitted, dispensing through a discharge outlet, at least a part of the liquid washing agent contained in said dosing space outside of said dispenser during a washing cycle of said household washing machine, by moving first plugging means between a first position, at which the liquid washing agent cannot reach said discharge outlet from said dispensing apace, and a second position at which the liquid washing agent can reach said discharge outlet from said dispensing space, downflow of liquid washing agent from said dosing space to said dispensing space being prevented when said first plugging means are in said second position, and downflow of liquid washing agent from said dosing space to said dispensing space being permitted when said first plugging means are in said first position.

33. A method according to claim 32, wherein downflow of liquid washing agent from said tank to said dosing space is prevented when said first plugging means permit downflow of washing agent to said discharge outlet, independently of whether said downflow is permitted due to said first plugging means having reached said second position or due to a malfunction of said first plugging means.

34. A method according to claim 32, wherein:

in said first position, said first plugging means prevent downflow of liquid washing agent from said dosing space to a said dispensing space and to permit downflow of liquid washing agent eventually contained in said dispensing space to said discharge outlet;

in said second position, said first plugging means permit downflow of liquid washing agent from said dosing space to said dispensing apace and prevent downflow of liquid washing agent eventually contained in said dispensing space to said discharge outlet.

35. A household washing machine comprising a dispensing device of washing agents, said dispensing device comprising a tank for containing a liquid washing agent and an arrangement for dispensing a dose of said liquid washing agent, said arrangement comprising:

a passage adapted to put the inside of said tank in communication with a discharge outlet for said liquid washing agent;

a dosing chamber for said liquid washing agent in hydraulic communication with said tank and said passage, said dosing chamber being adapted for at least partially dispensing said liquid washing agent contained therein in a washing cycle of said household washing machine;

first plugging means acting on said passage and capable of taking a first position, in which the washing agent cannot reach said discharge outlet, and a second position, in which the washing agent is able to reach said discharge outlet;

first actuating means producing actuation of said first plugging means, and further comprising second plugging means operative along said passage to prevent washing agent downflow from said tank to said dosing chamber;

second actuating means operatively connected to said second plugging means and adapted to produce actuation of said second plugging means independently of the position of said first plugging means, the first plugging means being provided for dispensing at least part of the liquid agent contained in said dosing chamber in a washing cycle of said household washing machine.

36. A dispensing device of washing agents for a household washing machine, said dispenser having at least a tank for containing a liquid washing agent and an arrangement for dispensing a dose of said liquid washing agent, said arrangement comprising:

a passage adapted to put the inside of said tank in communication with a discharge outlet for said liquid washing agent;

a dosing chamber of said liquid washing agent in hydraulic communication with said tank;

first plugging means acting on said passage and capable of taking a first position, in which the washing agent cannot reach said discharge outlet, and a second position, in which the washing agent is able to reach said discharge outlet;

actuating means producing actuation of said first plugging means;

second plugging means, operating along said passage and normally operative along said passage to prevent washing agent downflow from said tank to said dosing chamber;

a dispensing chamber of said liquid washing agent being in hydraulic communication with said dosing chamber, said first plugging means operating between said dosing chamber and said dispensing chamber, the dispensing chamber being in hydraulic communication with the discharge outlet.

37. A device according to claim 36, wherein:

in said first position, said first plugging means prevent downflow of liquid washing agent from said dosing chamber to said dispensing chamber and permit downflow of liquid washing agent eventually contained in said dispensing chamber to said discharge outlet;

in said second position, said first plugging means enable downflow of liquid washing agent from said dosing chamber to said dispensing chamber and prevent downflow of liquid washing agent eventually contained in said dispensing chamber to said discharge outlet.

38. A device according to claim 36, further comprising venting means for communication with the environment outside said tank and/or said dosing chamber and/or said dispensing chamber.

39. A device according to claim 36, wherein said second plugging means is adapted to be completely immersed in the liquid washing agent contained in said dosing chamber while said actuating means are outside said dosing chamber.

40. A device according to claim 36, wherein at least one of said first and said second plugging means comprises an element made from ferromagnetic material with which sealing means are associated.

41. A device according to claim 36, wherein said actuating means comprise a first actuator for operating said second plugging means, and a second actuator for operating said first plugging means.

42. A device according to claim 36, wherein said actuating means comprise a sole actuator with a sole mechanism adapted to produce actuation of said first and second plugging means at different times.

43. A device according to claim 36, wherein said actuating means comprise a slow operating actuator.

44. A device according to claim 36, wherein said actuating means comprise a solenoid.

45. A device according to claim 44, wherein said first plugging means comprise an armature of said solenoid.

46. A device according to claim 36, further comprising a magnetic element associated with a component of a mechanism operated by said actuating means.

47. A device according to claim 46, wherein said magnetic element is associated with a component of said mechanism.

48. A device according to claim 46, wherein said component is angularly movable.

49. A device according to claim 46, wherein during the movement of said component the attraction force exerted by said magnetic element is capable of producing movement of said second plugging means from said first position to said second position, or from said second position to said first position.

50. A household washing machine comprising a dispensing device of washing agents, said dispensing device having at least a tank for containing a liquid washing agent and an arrangement for dispensing a dose of said liquid washing agent, said arrangement comprising:

a passage adapted to put the inside of said tank in communication with a discharge outlet for said liquid washing agent and comprising a dosing chamber of said liquid washing agent in hydraulic communication with said tank;

first plugging means acting on said passage and capable of taking a first position, in which the washing agent cannot reach said discharge outlet, and a second position, in which the washing agent is able to reach said discharge outlet;

actuating means producing actuation of said first plugging means;

second plugging means, operating along said passage and normally operative along said passage to prevent washing agent downflow from said tank to said dosing chamber;

said passage further comprising a dispensing chamber of said liquid washing agent being in hydraulic communication with said dosing chamber, said first plugging means operating between said dosing chamber and said dispensing chamber, the dispensing chamber being in hydraulic communication with the discharge outlet.

51. A household washing machine comprising a dispensing device of washing agents, said dispensing device comprising a tank for containing a liquid washing agent and an arrangement for dispensing a dose of said washing agent, said arrangement comprising:

a dosing space adapted to receive and contain at least a portion of the liquid washing agent contained in said tank, said portion of the liquid agent being at least partially dispensed in a washing cycle of said household washing machine;

a passage adapted to permit downflow of liquid washing agent from said dosing space to a discharge outlet of said liquid washing agent;

first plugging means acting on said passage and capable of taking a first position at which the washing agent cannot reach said discharge outlet, and a second position, at which the washing agent is able to reach said discharge outlet;

an actuator capable of actuating said first plugging means, and comprising safety means switching between first and second operating conditions, where:

in the first operating condition, reached when said first plugging means are in said second position, said safety means prevent downflow of liquid washing agent from said tank to said dosing space;

in the second operating condition, reached when said first plugging means are in said first position, said safety means permit downflow of liquid washing agent from said tank to said dosing space in order to define a washing liquid agent dose to be at least partially dispensed in a washing cycle of said household washing machine.

* * * * *